US008157753B2

(12) United States Patent
Nichols

(10) Patent No.: US 8,157,753 B2
(45) Date of Patent: Apr. 17, 2012

(54) PERSONAL CARE VAPORIZING DEVICE

(76) Inventor: Thomas Nichols, Laguna Niguel, CA (US)

( * ) Notice: Subject to any disclaimer, the term of this patent is extended or adjusted under 35 U.S.C. 154(b) by 1056 days.

(21) Appl. No.: 12/079,747

(22) Filed: Mar. 27, 2008

(65) Prior Publication Data

US 2009/0247913 A1 Oct. 1, 2009

(51) Int. Cl.
*A61H 1/00* (2006.01)

(52) U.S. Cl. ..... 601/17

(58) Field of Classification Search ..... 601/16, 601/17, 18

See application file for complete search history.

(56) References Cited

U.S. PATENT DOCUMENTS

| | | | | |
|---|---|---|---|---|
| 158,919 | A | 8/1904 | Fung | 4/537 |
| 208,104 | A | 9/1906 | DeBoer | 239/318 |
| 123,808 | A | 5/1907 | Rhoades | 601/73 |
| 4,616,122 | A | 10/1986 | Burian | 219/273 |
| 5,098,414 | A | 3/1992 | Walker | 604/291 |
| 6,001,070 | A * | 12/1999 | Gebhard | 601/15 |
| 6,090,085 | A * | 7/2000 | Mehl et al. | 604/291 |
| 6,755,398 | B1 * | 6/2004 | Wong | 261/81 |
| 7,934,703 | B2 * | 5/2011 | Tomono et al. | 261/18.1 |
| 2004/0084787 | A1 * | 5/2004 | Williams et al. | 261/72.1 |

FOREIGN PATENT DOCUMENTS

WO WO2006/095816 * 3/2006

* cited by examiner

*Primary Examiner* — Patricia Bianco
*Assistant Examiner* — Raymond E Harris
(74) *Attorney, Agent, or Firm* — Stews & Associates, P.C.

(57) ABSTRACT

A Personal Care Vaporizing Device is disclosed. The device has a central base unit including a large removable liquid reservoir and a handheld skin massage/exfoliating device. The handheld assembly can selectively emit vapor directly to the skin surface. Unlike the prior devices in the field, the present invention allows the user to selectively dispense either cool or warm vapor. The liquid reservoir is designed to accept skin care additives in addition to simple water for generating the vapor. The device has at least three operational modes: vapor only, massage head brush oscillation/massage motion only, and both vapor and oscillation/massage. Power for the device is available from a variety of sources, including internal batteries and/or external power supply.

25 Claims, 6 Drawing Sheets

PERSONAL CARE VAPORIZING DEVICE

BACKGROUND OF THE INVENTION

1. Field of the Invention

This invention relates generally to facial skin care devices and, more specifically, to a Personal Care Vaporizing Device.

2. Description of Related Art

Facial massage devices are plentiful. The most pertinent examples of conventional devices and systems in this field are: Mehl, Sr., et al, U.S. Pat. No. 6,090,085, Walker, U.S. Pat. No. 5,098,414, and Burian, U.S. Pat. No. 4,616,122.

Mehl is a "Skin Moisturizing and Buffing Device." The Mehl system combines a handheld facial buffer that has an internal steam generator for creating a stream of steam for emission through the "movable skin contacting assembly" (i.e. the facial buffer head). While the Mehl device does provide a handheld steam buffer, it fails to allow the user the option of either cool vapor or heated steam emitted through the buffer head. Furthermore, the amount of vapor available for use is severely limited due to the entire package being of handheld size. A device providing a large volume liquid reservoir that can emit either heated steam or cool vapor would provide a wider set of benefits to the user.

Walker is a "Steam Device for Cosmetic Skin Treatment." The Walker device does provide a large water reservoir for use in steam emission, but it fails to provide the option of cool vapor.

Finally, the Burian "Electrically Heated Facial Sauna Vapor Generating Apparatus," like Walker discloses a large-reservoir, steam generating facial massage device. Just as with Walker, Burian fails to suggest the generation of cool vapor (in addition to hot steam) for facial application through the massage head. The ability to deliver hot or cool vapor through the massage head allows the user to continue the facial massage while heating and cooling the massage head and skin. If only the only option is to deliver steam, then the user must either stop the massage or stop the vapor delivery in the event that the face becomes uncomfortably hot.

SUMMARY OF THE INVENTION

In light of the aforementioned problems associated with the prior devices and systems, it is an object of the present invention to provide a Personal Care Vaporizing Device. The device should have a central base unit having a large removable liquid reservoir and a handheld skin massage/exfoliating device. The handheld assembly should emit vapor directly to the skin surface. Unlike the prior devices in the field, the present invention should allow the user to selectively dispense either cool or warm vapor. The liquid reservoir should also be designed to accept skin care additives in addition to simple water for generating the vapor. The device should have at least three operational modes: vapor only, massage head brush oscillation/massage motion only, and both vapor and oscillation/massage. Power for the device should be available from a variety of sources, including internal batteries and/or external power supply.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Personal Care Vaporizing Device.

Figure 1:
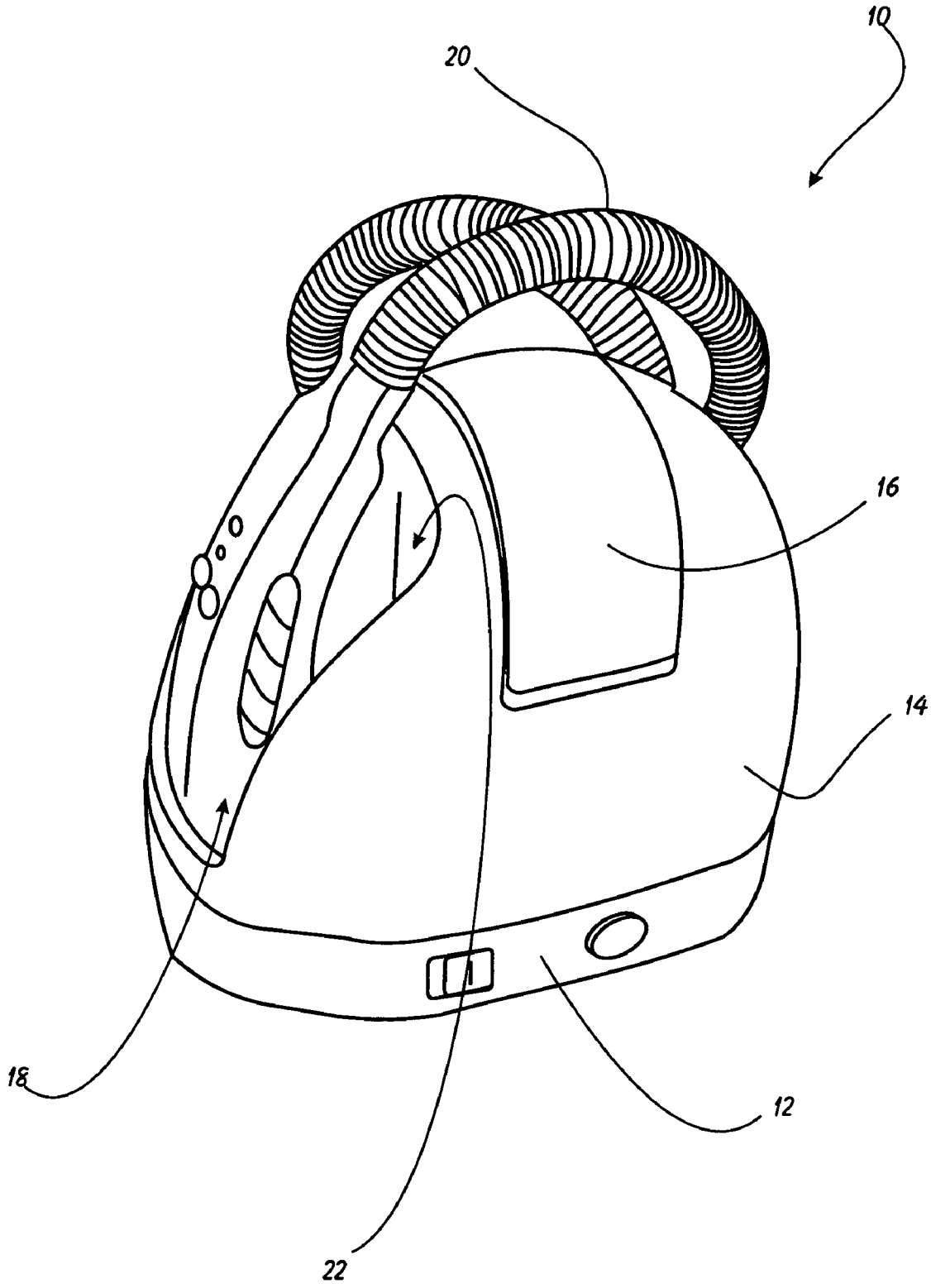
FIG. 1 is a perspective view of a preferred embodiment of the massaging vaporizer device of the present invention.

The present invention can best be understood by initial consideration of FIG. 1. FIG. 1 is a perspective view of a preferred embodiment of the massaging vaporizer device 10 of the present invention. The device 10 is an advancement over the prior art in that it not only provides a substantial liquid reservoir for vapor generation, but also gives the user the option of either hot steam or cool vapor application through the massage head.

The device 10 has a base element 12 which provides a support base for the other elements that make up the device 10. An upper housing 14 is attached atop the base element 12. A reservoir tank 16 is removably attached to the upper housing 14.

As can be seen, the shape of the base element 12, upper housing 14 and reservoir tank 16 are not only ergonomically shaped, but also aesthetically pleasing. There is a holster 22 formed in the upper housing 14 that provides for a convenient storage location for the massage head assembly 18. It is noted that the massage head assembly 18 may be powered by internal batteries; in one version the holster 22 may also include a battery charger so that batteries in the massage head assembly 18 are recharged (if necessary) when the head assembly 18 is placed in the holster 22.

A mist hose 20 interconnects the upper housing 14 and the massage head assembly. The mist hose 20 can be removable from the upper housing, or alternatively, may retract into the upper housing.

There are control switches and buttons dispersed on the base element 12 and massage head assembly 18. There are electrical signal conductors interconnecting the massage head assembly and the upper housing 14 and/or base element 12. These wires or other conductors will be coupled with the mist hose 20, and could be located either on the exterior or the interior of the mist hose 20. The switches and buttons on the base element 12 and elsewhere will be described more fully below in connection with successive drawing figures, beginning with FIG. 2.

Figure 2:
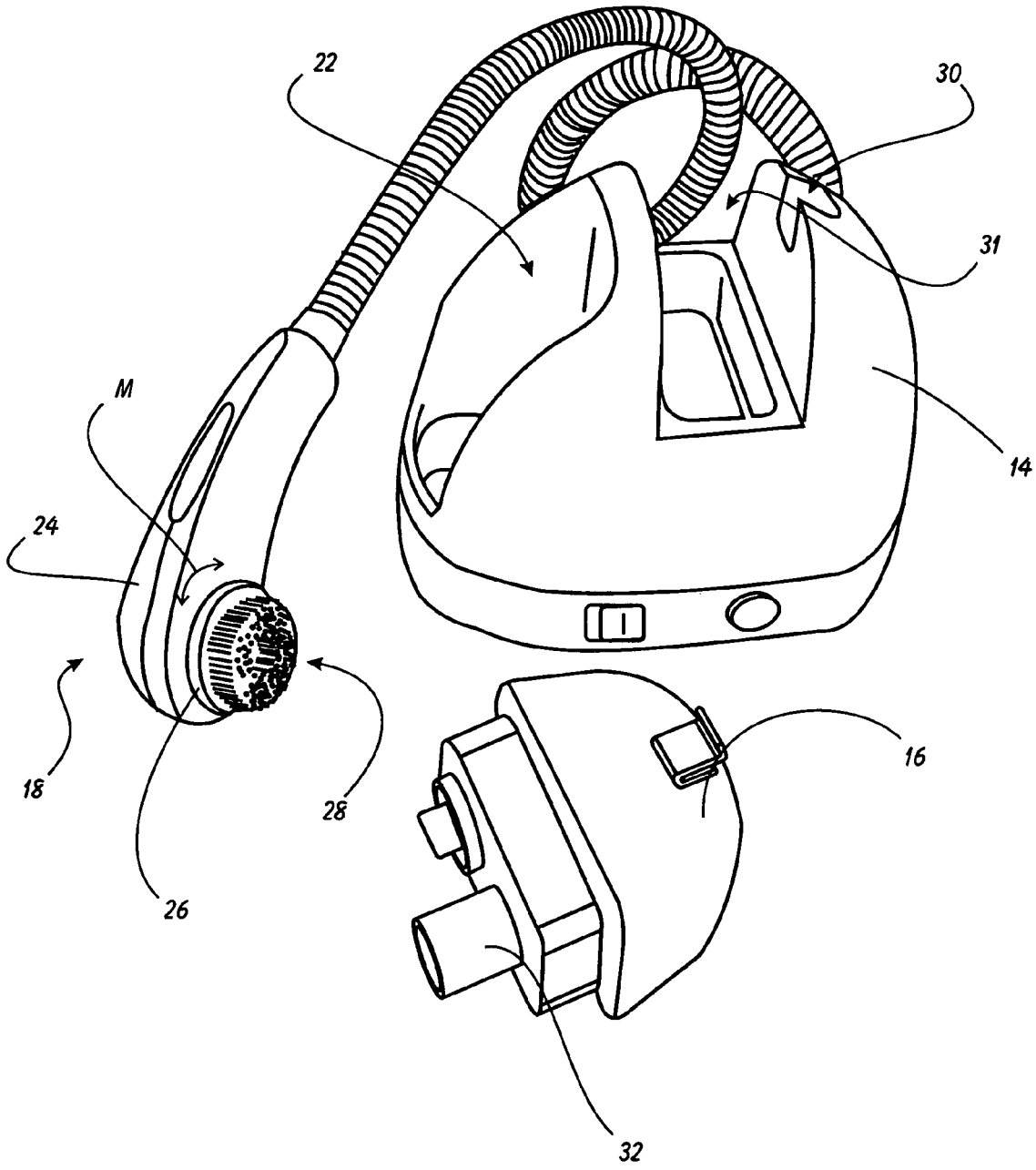
FIG. 2 is a partially exploded perspective view of the device of FIG. 1.

FIG. 2 is a partially exploded perspective view of the device 10 of FIG. 1. Here, the reservoir tank 16 has been removed from the upper housing 14. The tank 16 is designed to be removable so that the user can leave the device 10 plugged in at its operating location when adding fluid to the reservoir tank 16. When the tank 16 is installed in the tank holster 31 provided for in the upper housing 14, it is held therein by interface with the latch catch 30. At that point, fluid will be dispensed from the tank 16 through the outlet tube 32, and into the device's vapor-generating system.

The massage head assembly 18 comprises a head housing 24. A detachable brush element 26 is shown here; this element 26 can be exchanged with other types of elements, such as a massage head element. Other head elements may be provided. Each head element has at least one mist orifice 28 formed at its center to allow for vapor/mist to be emitted through the head element (e.g. 26). As discussed above, the vapor/mist is delivered to the head assembly 18 via the mist hose 20 (after the mist/vapor is generated in other components of the system 10. There is mechanism internal to the massage head assembly 18 that drives the brush element 26 in an oscillating motion "M" as shown by the arrow. In addition to the oscillating motion "M," the assembly 18 may also provide vibrational motion. The motion is provided to assist in the exfoliation, hydration and/or massage of the skin at a very high rate of oscillation and vibration. Now turning to FIG. 3, we can continue to examine the advancements of the present invention.

Figure 3:
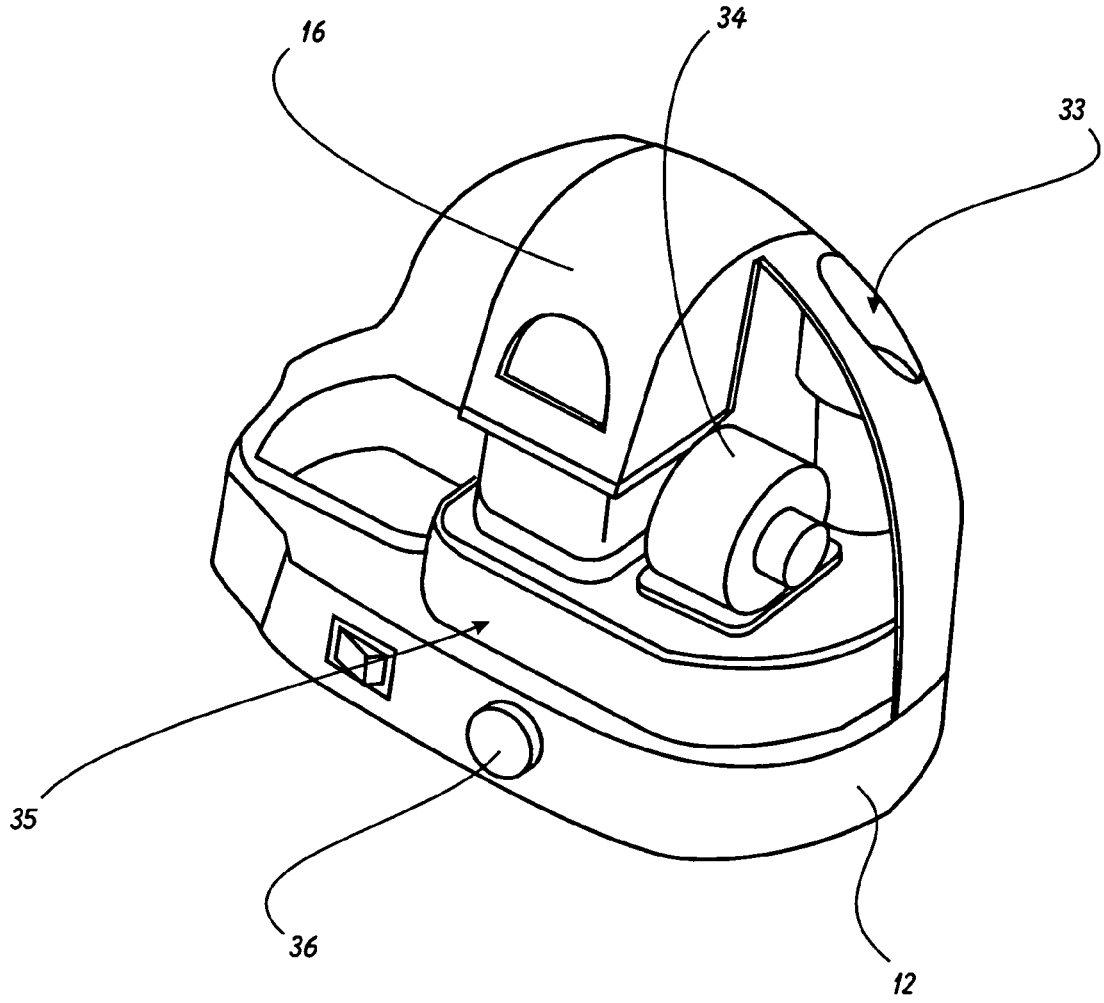
FIG. 3 is a perspective view of select internal elements of the device of FIGS. 1 and 2.

FIG. 3 is a perspective view of select internal elements of the device of FIGS. 1 and 2. The base element 12 has several operational mechanisms attached to its top surface. The reservoir tank 16 dispenses its liquid into the lower reservoir 35. The cool vapor is generated within the lower reservoir 35 and delivered to the massage head assembly (see FIG. 2) via the mist hose (see FIG. 1). The mist hose inserts into the hose socket 33; a mist aperture is located within the hose socket 33 (the vapor exits through the mist aperture).

The system has a blower motor 34 associated with it to drive the vaporized liquid out through the mist hose and massage head. The speed of the blower motor 34 is controlled by the speed control knob 36, so that the vapor volume can be adjusted to the desired level. The vapor-producing mechanism is discussed below in connection with FIG. 5; first we will review the operation of the reservoir tank and its associated operational mechanisms.

Figure 4:
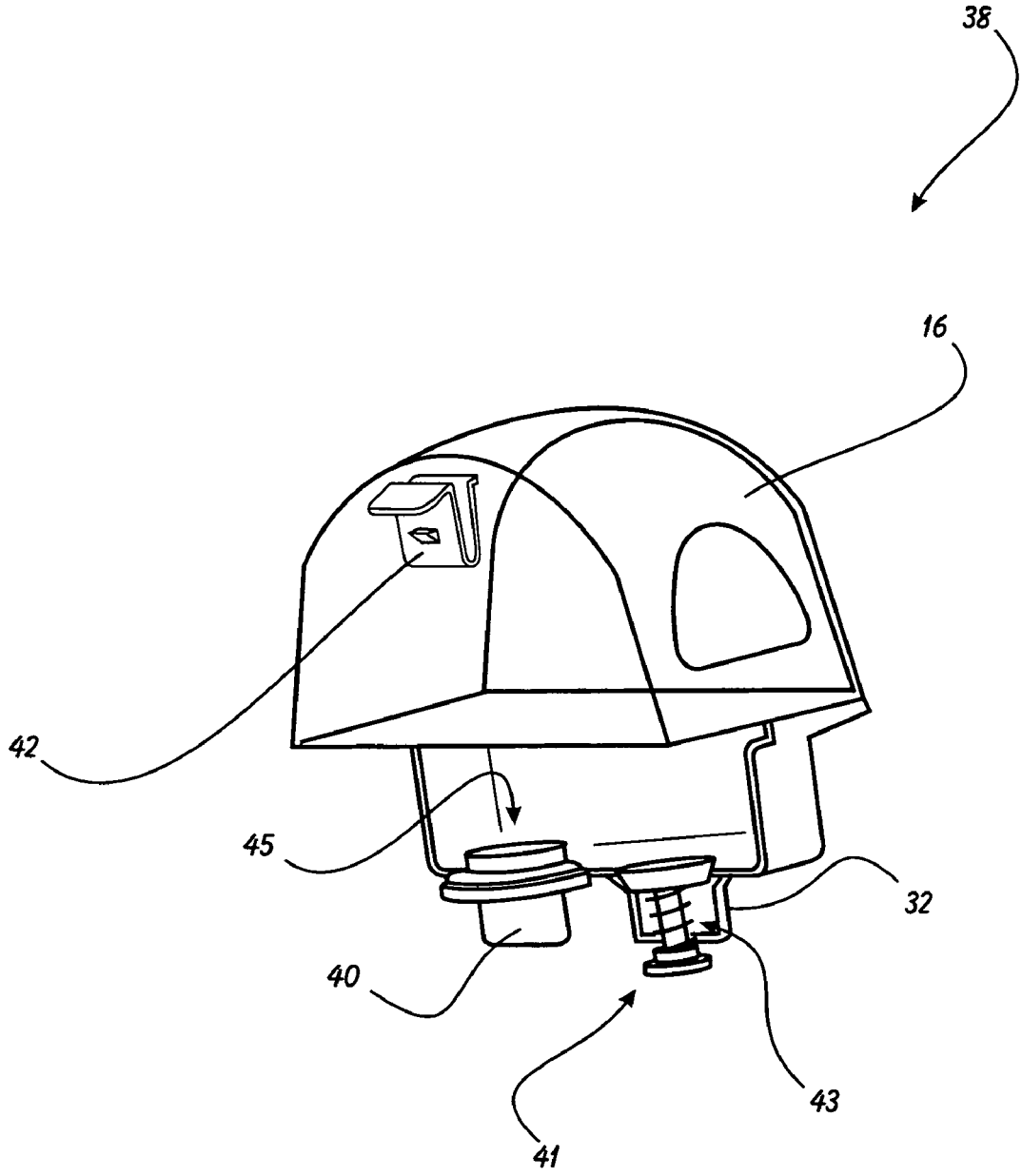
FIG. 4 is a perspective view of the tank assembly of the device of FIGS. 1-3.

FIG. 4 is a perspective view of the tank assembly 38 of the device of FIGS. 1-3. As shown here, the reservoir tank 16 is transparent so that the fluid level can be easily monitored during use. The outlet tube 32 extends downwardly from the bottom face of the reservoir tank 16. A feed valve 41 is located at the inner opening of the outlet tube 32 to control the release of fluid out through the outlet tube 32. The feed valve 41 is spring loaded to remain closed until the tank assembly 38 is placed into the base assembly (see FIG. 5). When the assembly 38 is locked into the base assembly (see FIG. 5), the feed valve 41 will be forced upwardly (against the force of the biasing spring 43) so that the feed valve 41 will open. Additionally, a fill cap 40 is provided; to fill the tank 16, the user need simply turn the tank 16 upside down, remove the fill cap 40, and fill through the fill opening 45.

An important feature of the device of the present invention is the ability to combine water with other ingredients within the reservoir tank 16. For example, extracts and essential oils can be added to the water in the reservoir tank 16; the liquid mixture can then be vaporized and delivered to the skin through the massage head assembly to improve the rate of absorption of the additive skin care ingredients.

The reservoir tank 16 is preferably defined by a latch element 42 extending from the upper portion of one of the sidewalls of the tank 16. The latch element 42 is designed to cooperate with the latch catch 30 (see FIG. 2) to secure the tank assembly 38 in its seat position in the upper housing 14 (see FIG. 2). To release the latch element 42, one need only press the free end of the catch element 42 towards the attachment point of the latch element 42 (on the tank 16). If we now turn to FIG. 5, we can continue to examine the novel features of the present device and system.

Figure 5:
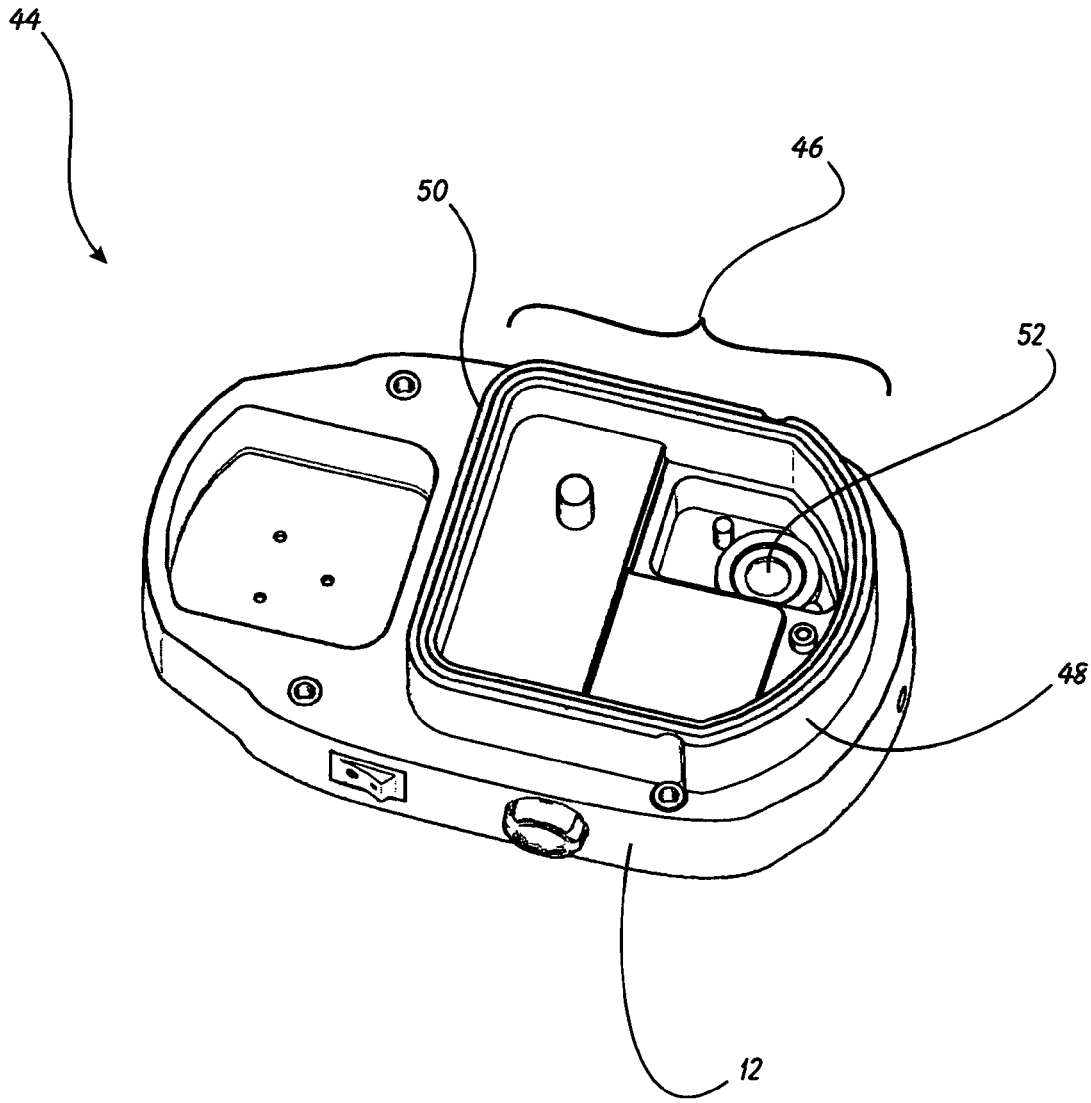
FIG. 5 is a perspective view of the base assembly of the device of FIGS. 1-5.

FIG. 5 is a perspective view of the base assembly 44 of the device of FIGS. 1-5. The main structural element of the base assembly 44 is the base element 12. The base element 12 defines a reservoir recess 46 on its upper face. Review of the previous drawing figures should make it apparent that the reservoir tank 16 outlet tube 32 will feed into the reservoir recess 46 when the tank 16 is placed in its location nestled in the upper housing 14 as depicted in FIG. 1. As such, the reservoir recess 46 will be gravity-filled with liquid so long as there is liquid remaining in the reservoir tank 16 (see FIG. 4).

The reservoir recess 46 is formed at its perimeter by the reservoir curb 48. A gasket 50 is dispersed around the upper edge of the curb 48 in order to create a leak-preventive seal between the upper housing 14 (see FIG. 1) and the base element 12.

A sonic transmitter 52 is located in the bottom of the reservoir recess 46, so that it is in fluid communication with any liquid located within the reservoir recess 46. The sonic transmitter 52 provides much of the unique functional features of the present invention, namely, that the liquid can be dispensed through the massage head as either cool vapor or heated steam. The sonic transmitter 52 is sized such that it can create sufficient mechanical vibration of the liquid in the reservoir recess 46 to vaporize the liquid. As the liquid is vaporized by the sonic transmitter 52, it is forced through the mist hose 20 (see FIG. 1) by forced air created by the blower motor 34 (see FIG. 3), and its associated blower fan. We will finally turn to FIG. 6 to complete our study of the device/system.

Figure 6:
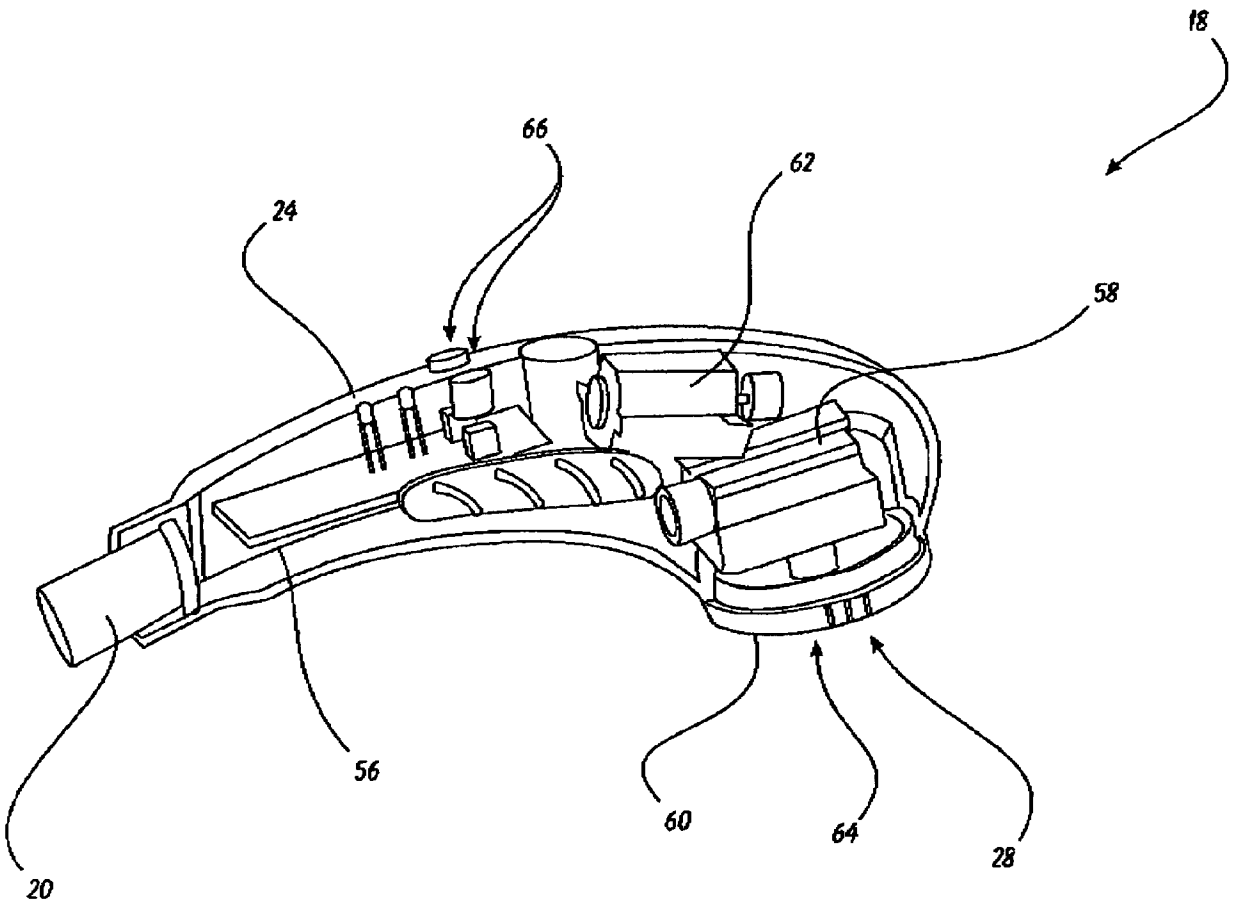
FIG. 6 is a cutaway side view of the massage head assembly of the device of FIGS. 1-5.

FIG. 6 is a cutaway side view of the massage head assembly 18 of the device of FIGS. 1-5. The massage head assembly 18 comprises a head housing 24 having an ergonomic shape for comfort during use. The face 60 of the housing 24 has a drive shaft 64 for driving the detachable element as depicted above in FIG. 2. The mist orifice 28 formed in the face 60 is supplied with vapor mist via the mist conduit 56 which interconnects the mist hose 20 with the mist orifice 28.

The mist conduit 56 is a section of heat tolerant tubing. One section of the conduit 56 passes through the heater module 58. The heater module 58 is configured to convert the cool vapor passing through the conduit 56 into steam before the vapor stream reaches the mist orifice 28. The heater module 58 can be selectively turned on or off using the switch buttons 66 located on the back of the housing 24. There could also be an adjustable thermostat that allows the user to adjust the amount of heat generated by the heater module 58 (and therefore the temperature of the vapor). As discussed above, the ability to provide cool vapor or heated steam through the face 60 of the massage head assembly 18 is unique to the present invention and is a sought-after feature previously unavailable in the prior devices and systems.

At least three function modes can be selected for device operation—vapor only (hot or cool), oscillation/vibration of drive motor 62 (no vapor), and both vapor and oscillation/vibration.

Although not depicted here, it is noted that power to the device 10 could be provided via internal batteries or from an external power source (i.e. from a wall socket).

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A vaporizer device, comprising:

a base assembly comprising:

a liquid reservoir;

a vaporizer element configured to vaporize liquid fed to said vaporizer from said liquid reservoir, said vaporizer element forming cool vapor by vaporizing said liquid without application of heat; and an applicator head;

a mist conduit in fluid communication with said vaporizer element and said applicator head; and a heater module located within said applicator head for selectively heating said vaporized liquid in said mist conduit before it exits said applicator head said applicator head being external to said base assembly.

2. The device of claim 1, wherein said base assembly is located in spaced relation to said applicator head.

3. The device of claim 2, said base assembly further comprising a base element, said base element defined by said vaporizer element, said vaporizer element being a sonic transmitter.

4. The device of claim 3, where said base element is further defined by reservoir recess formed in a top side of said base element, said sonic transmitter located in said reservoir recess and said liquid reservoir comprising a detachable tank at least partially insertable into said reservoir recess.

5. The device of claim 4, wherein said reservoir recess is defined by a reservoir curb extending upwardly from said top side of said base element.

6. The device of claim 5, further comprising an upper housing attachable to said base element, said upper housing and said base element cooperatively designed to create a water-proof seal between said upper housing and said reservoir curb.

7. The device of claim 6, wherein said upper housing is further defined by a tank holster formed therein, said tank holster and said liquid reservoir respectively cooperatively designed such that said liquid reservoir is removably insertable within said tank holster.

8. The device of claim 7, wherein said liquid reservoir further comprises a latch element extending therefrom and said upper housing is further defined by a latch catch that cooperates with said latch element whereby said latch element interacts with said latch catch to secure said liquid reservoir to said tank holster.

9. The device of claim 8, wherein said applicator head is further defined by a face, said face defined by a mist orifice in fluid communication with said mist conduit.

10. The device of claim 9, wherein said applicator head is further defined by a drive shaft extending from said face, said drive shaft operably connected to a drive motor located within said applicator head.

11. The device of claim 10, further comprising a detachable brush element for attachment to said drive shaft.

12. A device for cleansing, exfoliating and hydrating a human's skin, comprising:

a liquid reservoir tank comprising an outlet tube extending from said tank, said outlet tube further comprising a feed valve located therein;

a sonic vaporizer element contained within a combination base element and upper housing, said sonic vaporizer element configured to vaporize liquid fed to said sonic vaporizer from said liquid reservoir, said vaporizer element vaporizing said liquid by applying high frequency vibration to said fed liquid;

a massage head assembly comprising a head housing, said head housing external to said base element and said upper housing;

a mist conduit in fluid communication with said sonic vaporizer element and said massage head assembly; and a heater module located within said head housing for selectively heating said vaporized liquid in said mist conduit before it exits said head housing.

13. The device of claim 12, wherein said head housing is further defined by a face, said face defined by a mist orifice in fluid communication with said mist conduit.

14. The device of claim 13, wherein said massage head housing is further defined by a drive shaft extending from said face, said drive shaft drivable by a drive motor located within said head housing.

15. The device of claim 14, further comprising a detachable massage element for attachment to said drive shaft.

16. The device of claim 15, wherein said sonic vaporizer element is located in spaced relation to said massage head assembly, said massage head assembly and said sonic vaporizer element interconnected for vapor flow by said mist conduit.

17. The device of claim 16, further comprising a base element, said base element defined by said sonic vaporizer element, said base element further defined by a reservoir recess formed in a top side of said base element, said sonic transmitter located in said reservoir recess and said liquid reservoir tank at least partially insertable into said reservoir recess.

18. A device for cleansing, exfoliating and hydrating a human's skin, comprising:

a liquid reservoir tank comprising an outlet tube extending from said tank, said outlet tube further comprising a feed valve located therein;

a sonic vaporizer element contained within a combination base element and upper housing, said sonic vaporizer element configured to vaporize liquid fed to said sonic vaporizer from said liquid reservoir, said vaporizer element vaporizing said liquid by applying high frequency vibration to said fed liquid;

a massage head assembly comprising a head housing from which a detachable massage element extends, said massage element having at least one mist discharge orifice formed therein, said head housing external to said base element and said upper housing;

a mist conduit in fluid communication with said sonic vaporizer element and said one or more mist discharge orifices; and a drive motor within said head housing, said drive motor operatively associated with said detachable massage element whereby operation of said motor generates movement at said detachable massage element.

19. The device of claim 18, further comprising a drive shaft interconnecting said drive motor and said detachable massage element.

20. The device of claim 19, further comprising:

a base element defining a top surface;

an upper housing extending from said top surface for form an internal chamber between said base element and said upper housing;

a lower reservoir contained within said internal chamber;

a detachable fluid tank element insertable into said upper housing whereby it is in fluid communication with said lower reservoir; and a head housing holster formed in said upper housing, said holster formed cooperatively with said head housing to accept said head housing therein.

21. A method for massaging the skin, comprising the steps of:

placing a massage element extending from a head housing against the skin generating motion between said massage element and said skin by operation of a drive motor contained within said head housing;

generating a mist by applying mechanical vibration to a fluid to vaporize said fluid, said generating conducted within a base assembly, said head housing of said placing step external to said base assembly of said mist generating step; and blowing said vaporized fluid down a mist conduit and out through one or more orifices formed in said massage element, said blowing conducted by operation of a blower, and said mist conduit interconnecting said base assembly and said head housing.

22. The method of claim 21, further comprising the step of heating said vaporized fluid within said head housing.

23. The method of claim 21, further comprising the step of mixing water with one or more other ingredients prior to said mist generating step.

24. The method of claim 23, wherein said other ingredients of said mixing step are selected from the group of extracts and essential oils.

25. The method of claim 24, further comprising the step of heating said vaporized fluid within said head housing before said mist is blown out through said one or more orifices, said heating conducted after said mist generating step.

* * * * *